United States Patent [19]

Nazar

[11] Patent Number: 4,474,407

[45] Date of Patent: Oct. 2, 1984

[54] PORTABLE CHAIR WITH INSULATED SEAT COOLER

[76] Inventor: Robert C. Nazar, 3730 Longview Dr., Carlsbad, Calif. 92008

[21] Appl. No.: 311,881

[22] Filed: Oct. 15, 1981

[51] Int. Cl.[3] ..... A47C 7/62

[52] U.S. Cl. ..... 297/192; 297/183; 297/188; 297/377; 297/378; 312/235 R

[58] Field of Search ..... 297/192, 193, 191, 194, 297/188, 377, 241, 378, 183; 5/442, 462; 312/214, 235 R; D6/64

[56] References Cited

U.S. PATENT DOCUMENTS

| | | | |
|---|---|---|---|
| D. 258,178 | 2/1981 | Bayne | D6/64 X |
| 1,302,397 | 4/1919 | McEinan | 297/192 X |
| 1,900,847 | 3/1933 | Siday | 297/192 X |
| 2,264,744 | 12/1941 | Dunnam | 312/235 R |
| 2,357,214 | 8/1944 | McDole | 297/192 X |
| 3,114,574 | 12/1966 | Pryale | 297/193 |
| 3,560,047 | 2/1971 | Davis | 297/192 |
| 3,567,263 | 3/1971 | McKinney | 292/241 |
| 4,210,363 | 7/1980 | Taipalus | 297/192 |
| 4,353,182 | 10/1982 | Junkas et al. | 312/235 R |

*Primary Examiner*—James T. McCall
*Attorney, Agent, or Firm*—Freling E. Baker

[57] ABSTRACT

There is disclosed an ingenious portable foldable chair, constructed of moulded plastic or the like, provided with a seat having therein a hollow thermally insulated compartment. Said compartment may be lined and may be provided with a locking seat compartment access panel or door which provides sealing of said compartment and access to perishable foodstuffs, canned or bottled beverages, ice, fishing bait, or the like.

7 Claims, 4 Drawing Figures

PORTABLE CHAIR WITH INSULATED SEAT COOLER

BACKGROUND OF THE INVENTION

1. Field of the Invention

This invention relates to portable chairs of the picnic or beach variety which may be provided with a locking thermally insulated seat compartment for both carrying and insulating perishable foodstuffs, canned or bottled beverages, ice or the like.

2. Prior Art

Known folding chairs constructed of tubular aluminum with nylon or canvas covering material or the like are well known. These portable chairs have the virtue of being very light to carry and provide an inexpensive means for comfortable reclining. Many conventional chairs open merely to one position and are provided with legs. Some of these chairs include a seat portion and a back portion which is positioned directly on the sand or ground.

To spend the day at the beach, conventional practice involves using and carrying a comfortable chair, a portable cooler for beverages and lunches, and a container to hold towels and other small articles. This conventional practice is relatively expensive and cumbersome to carry. Known folding chairs have the disadvantage of not possessing any storage facilities which can hold small articles and thermally insulate perishable foodstuffs or bottled beverages.

A number of alternative means for constructing folding chairs have been proposed to overcome these recognized inadequacies of the conventional chairs. For example, several chairs have been devised with storage capability for beach or camping. Grebow et al U.S. Pat. No. 3,955,849 discloses such a beach chair formed of canvas with storage pockets provided on the sides of the seat for accessories.

Similarly, Menke U.S. Pat. No. 3,947,903 discloses a folding couch for beach or camping with a fabric sling arrangement for carrying and securing books and other objects.

Several arrangements have been proposed to provide a beverage or lunch container directly in a folding chair. Bramming U.S. Pat. No. 3,120,404 discloses a pair of folding seats with a container for holding vacuum bottles and sandwiches. Similarly, Davis U.S. Pat. No. 3,560,047 discloses a portable chair with a seat having therein a hollow thermally insulated container with means to introduce and dispense liquids.

Each of these alternatives has certain deficiencies. The chairs with pouches or compartments for carrying objects still require insulating means for perishable foodstuffs, fishing bait, ice or the like and are susceptible to tearing and wear as they are constructed of fabric or canvas. The portable chair in the Bramming patent still requires insulating means for foodstuffs and the glass vacuum bottles are susceptible to breakage in transport.

The alternative means proposed by Davis still require insulating and carrying means for perishable foodstuffs and the like. Additionally, this disclosure by Davis requires a wire hook securing device to a supporting plank or the like and may suffer from tipping when utilized on the beach or ground.

SUMMARY OF THE INVENTION

It is an object of this present invention to provide an adjustable foldable chair of the type as mentioned which overcomes at least some of the aforementioned disadvantages and concurrently therewith provides a thermally insulated storage facility for securing and storing canned or bottled beverages, ice, perishable foodstuffs, fishing bait, or other small objects.

It will be seen that the present invention overcomes some of these inadequacies by providing a hingedly secured locking access panel, lid, or similar means, to a thermally insulated compartment secured to or incorporated within a lightweight seat and easily accessible to the occupant of the seat.

One object of the present invention is to provide a new and improved device of the foregoing character which opens to provide a durable comfortable seat elevating the occupant from the ground or sand at the beach, picnics, fishing, or other similar activities.

A further object is to provide such a new and improved device in which the seat is provided with a collapsible back member. Still another object is to provide a device of the foregoing character having an adjustable folding back rest prop which supports the backrest and adjusts for individual comfort and reclining when the device is opened, prevents tipping of the device when occupied, and provides a convenient handle for carrying the device when it is folded.

Another object is to provide such a new and improved device which folds compactly for storage or transport and provides a handle for carrying the device. Still another object is to provide such a new and improved device having an insulated container which may be lined and which may be securely attached to or incorporated within the seat portion of the chair so that perishable foodstuffs, ice, canned beverages, fishing bait, or other articles in the container will be conveniently accessible to the occupant of the seat.

It is a further object to provide a new and improved device in which the seat and backrest members are provided with collapsible armrest members which open to provide arm support and comfort when the device is opened. Still another object to provide such a new and improved device of the foregoing character which is durable and lightweight. An additional object is to provide such a new and improved device which is easy to manufacture and low in cost.

These together with other objects and advantages which will become apparent reside in the details of construction and operation as will be more fully described and claimed, reference being made to the accompanying drawings forming a part hereof, wherein like numerals refer to like parts throughout and in which:

BRIEF DESCRIPTION OF THE DRAWINGS

The invention will hereafter be elucidated with reference to the drawings.

DETAILED DESCRIPTION OF THE INVENTION

Figure 1:
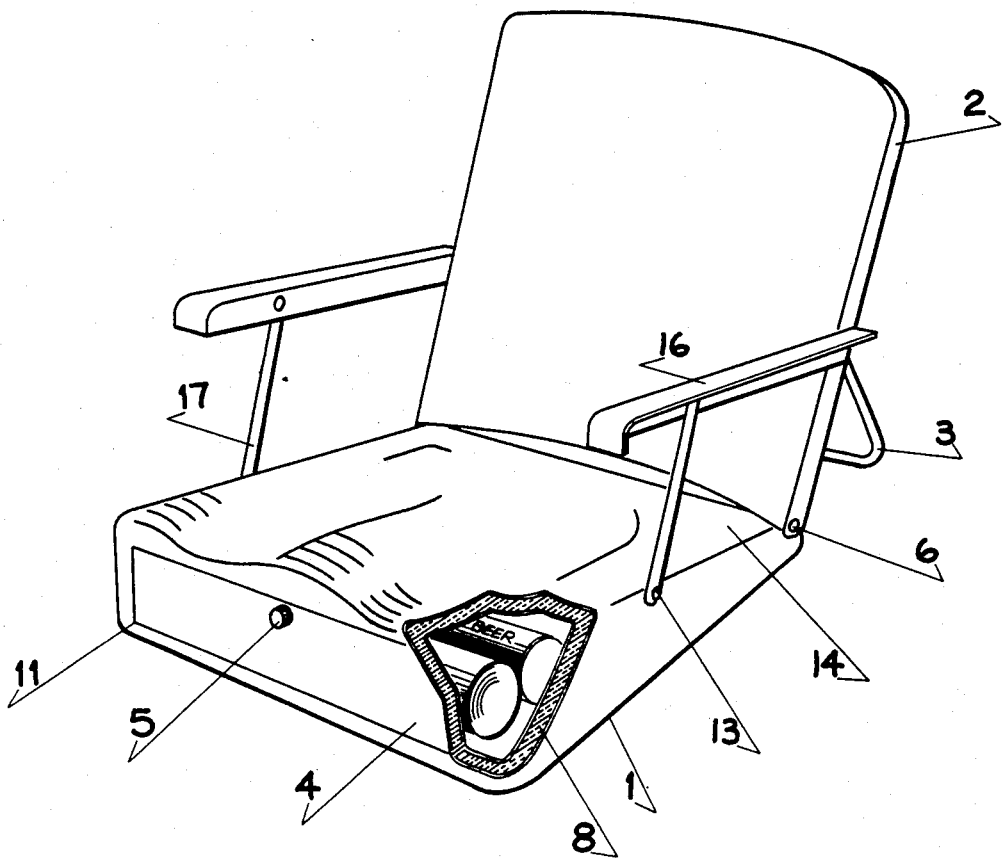
FIG. 1, is a perspective view of my invention in use with a cut away front view.
Figure 4:
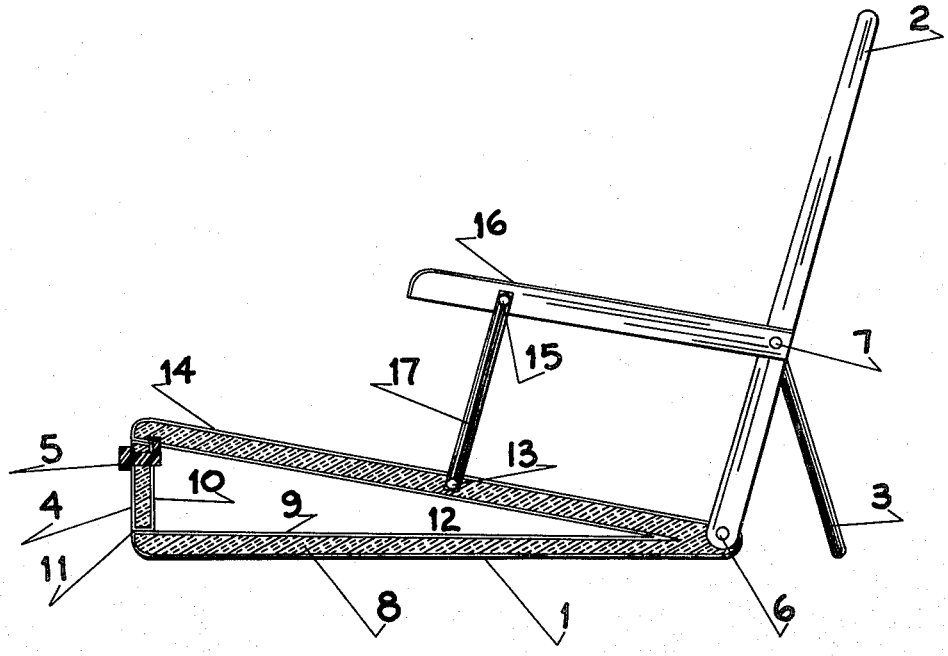
FIG. 4, is a cross sectional side view thereof.

Turning now to the drawings, with particular emphasis to FIGS. 4 and 1, it will be seen that the chair of this invention may include a hollow rectangular integrated one piece seat portion 1 of injection moulded plastic, nylon, or other suitable material, which may be equipped with a front access panel or door 4 of plastic or other suitable material, which can be hingedly connected to the front portion of the seat at 11.

The access panel or door 4 may be secured with a manually turning lock 5 of metal, plastic, or similar material which may additionally serve as a knob which may be grasped for opening said access panel. The purpose of the lock being to prevent release of carried items, to prevent theft of said items, and to tightly secure and seal insulated compartment. The inner or compartment portion off the access panel 4 may be provided with insulating material 8 of plastic, polyurethane foam, or the like and may be provided with a lining material 10 of plastic, thermoplastic, or other suitable material.

Figure 3:
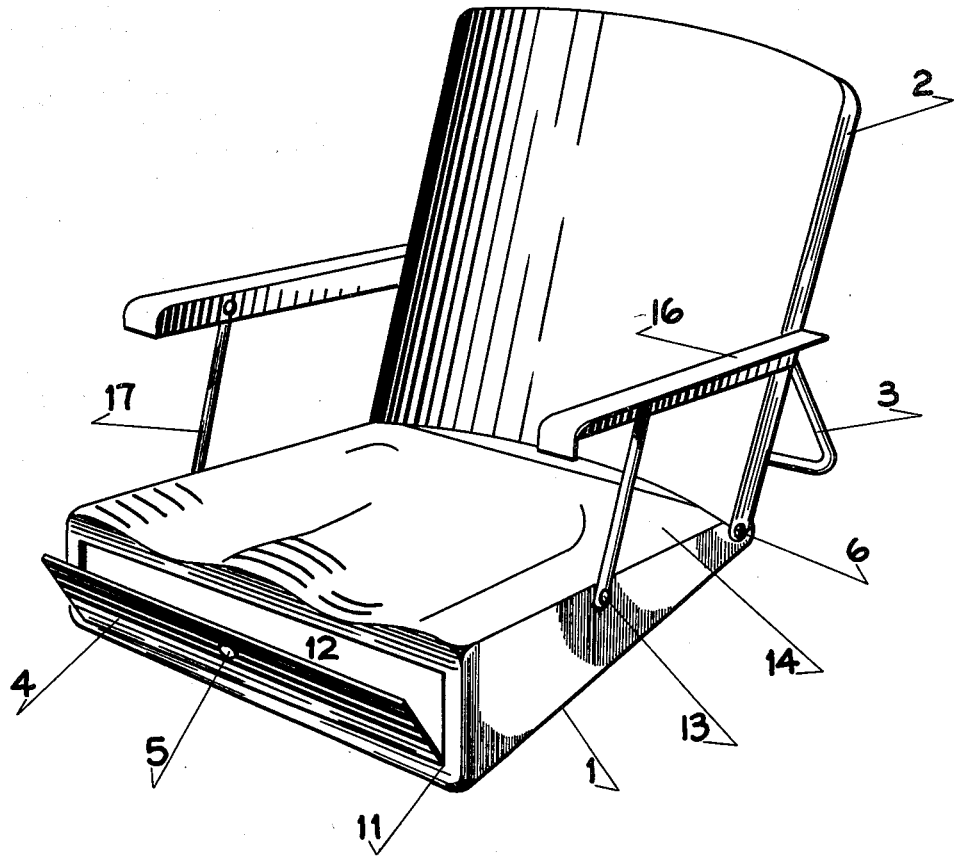
FIG. 3, is a perspective view of my invention in use.

The top portion of the seat 14 may be anatomically moulded as shown in FIG. 3 to the contour of the buttocks to provide added comfort to the occupant of the chair. Additionally, thermal insulating material 8 of polyurethane foam or similar insulating material, may be placed directly beneath and inside the top portion of the seat 14 and may also be placed on the inside bottom and sides of the hollow seat compartment. A protective and stiffening liner 9 of plastic, thermoplastic, or similar material, may be placed adjacent to the thermal insulating material 8 to protect the items contained in storage and to define the hollow inner compartment 12. The entire hollow seat portion may be inexpensively moulded in one piece so as to be lightweight, inexpensively made, and easily reinforced to prevent collapse when sat upon.

Figure 2:
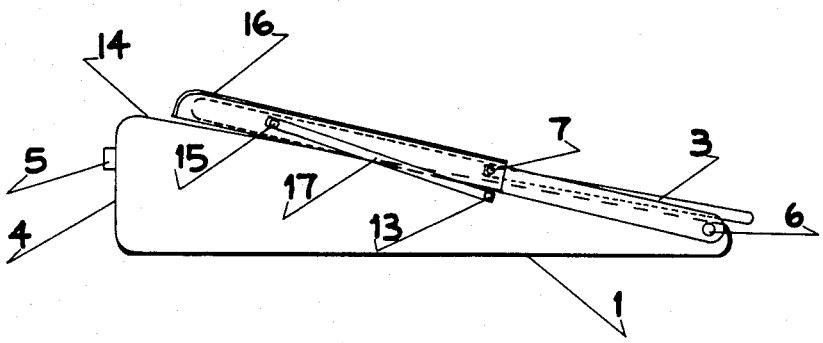
FIG. 2, is a detail side view showing my invention as folded.

A back member 2 of wood, metal, plastic, or other suitable material may be hingedly secured at 6 by means of rivets, screws, or the like, to seat base member 1 whereby the back rest 2 may extend upward and back from the top of the seat portion 14 for use, as in FIG. 4, or may be folded upon the top of the seat portion 14 for storage, as in FIG. 2.

A U-shaped block member, back member support prop 3 of tubular aluminum construction, plastic, or other suitable material, may be hingedly secured by rivets, screws, or the like as shown at 7 to back member 2 whereby the support prop 3 may extend back from the seat portion 1 for greater reclining and comfort and additionally to prevent tipping of the device when occupied, or may be folded upon the lower rear portion of the back support member to become a convenient handle for carrying as in FIG. 2.

To increase the comfort of the occupant the seat 1 may be provided with armrests 16 of wood, metal, plastic, or the like and may be hingedly secured by rivets, screws, or the like to backrest at 7 and hingedly secured by similar means to the armrest prop 17 at 15. Said armrest prop 17 may be constructed of similar materials and may be secured by similar means to seat base top portion 14 at 13.

From the above description and drawings it will be apparent that I have disclosed a seat and container combination comprising a hollow box-like housing having an upper generally rectangular wall defining a seat platform and a lower generally rectangular wall defining a generally horizontal support surface, said upper and lower walls being joined by a common back edge and generally triangular side walls defining a seat structure and an open front compartment, said upper and lower and said side walls being constructed of insulating material for thermally insulating said open front compartment, and an insulated closure panel for covering said open front and for providing access to said compartment for a person in a seated position on said seat support platform and a back rest pivotally secured to said housing.

Having illustrated and described a preferred embodiment as well as variants of this invention, it will be obvious to those skilled in the art that further changes and modifications may become apparent. Such changes and modifications are not to affect this instant concept and are to be considered within the scope and essence of this invention.

Having thus described this invention what is claimed as new is:

1. The combination of a portable insulated container and folding chair, comprising:

a hollow box-like housing having an upper generally rectangular wall defining a seat platform and a lower generally rectangular wall defining a generally horizontal support surgace, said upper and lower walls being joined by side walls defining a seat structure and an open front compartment, said upper and lower and said side walls being constructed of insulating material for thermally insulating said open front compartment, and an insulated closure panel for covering said open front and for providing access to said compartment for a person in a seated position on said seat support platform, a back rest pivotally secured to said housing for extending upward in a support position and foldable onto said seat platform, and a generally u-shaped combination prop and handle pivotally secured at the ends thereof to said back rest for engaging a support surface for supporting said back rest in said support position and for extending beyond an edge of said housing for defining a handle for carrying said container combination when said back rest is folded onto said seat platform for defining the container mode.

2. The combination of a portable insulated container and folding chair, comprising:

a hollow box-like housing having an upper generally rectangular wall defining a seat platform and a lower generally rectangular wall defining a generally horizontal support surface, said upper and lower walls being joined by side walls defining a seat structure and an open front compartment, said upper and lower and said side walls being constructed of insulating material for thermally insulating said open front compartment, and an insulated closure panel for covering said open front and for providing access to said compartment for a person in a seated postion on said seat support platform, wherein said upper surface slopes downward to join said lower surface at a common back edge, and said side walls have a triangular configuration, and a back rest pivotally secured to said housing.

3. The chair as set forth in claim 2 wherein:

said housing is constructed of a unitary construction of molded plastic defining the outer surface of said walls with an insulating lining adjacent said wall and an internal lining of plastic forming the inside surface of said walls defining said compartment.

4. The chair as set forth in claim 3 wherein said back rest includes a prop member pivotally secured thereto for engaging a horizontal support surface behind the chair for maintaining the back rest in a selected vertical position, said back rest being foldable to a position lying against the seat support surface and said support prop defining a handle for carrying said chair container combination when in the container mode.

5. The chair as set forth in claim 3 wherein said upper wall is molded to the contour of the buttocks to enhance the comfort of an occupant of the chair.

6. The chair as set forth in claim 1 wherein:

said housing is constructed of a unitary construction of molded plastic defining the outer surface of said walls with an insulating lining adjacent said wall and an internal lining of plastic forming the inside surface of said walls defining said compartment.

7. The chair as set forth in claim 6 wherein said upper wall is molded to the contour of the buttocks to enhance the comfort of an occupant of the chair.

* * * * *